US009205321B2

(12) United States Patent
Geiger

(10) Patent No.: US 9,205,321 B2
(45) Date of Patent: Dec. 8, 2015

(54) SNOWBOARD BINDING AND BRAKING SYSTEM

(71) Applicant: Steve Geiger, Wayland, MA (US)

(72) Inventor: Steve Geiger, Wayland, MA (US)

( * ) Notice: Subject to any disclaimer, the term of this patent is extended or adjusted under 35 U.S.C. 154(b) by 160 days.

(21) Appl. No.: 14/146,794

(22) Filed: Jan. 3, 2014

(65) Prior Publication Data

US 2014/0183842 A1 Jul. 3, 2014

Related U.S. Application Data

(60) Provisional application No. 61/748,607, filed on Jan. 3, 2013.

(51) Int. Cl.

| | |
|---|---|
| ***A63C 10/28*** | (2012.01) |
| ***A63C 7/10*** | (2006.01) |
| ***A63C 5/03*** | (2006.01) |
| ***A63C 10/14*** | (2012.01) |
| *A63C 10/04* | (2012.01) |

(52) U.S. Cl.
CPC . *A63C 10/28* (2013.01); *A63C 5/03* (2013.01); *A63C 7/108* (2013.01); *A63C 7/1066* (2013.01); *A63C 10/14* (2013.01); *A63C 7/1086* (2013.01); *A63C 10/04* (2013.01)

(58) Field of Classification Search
CPC ..... A63C 10/04; A63C 10/14; A63C 10/28; A63C 7/108; A63C 7/1086; A63C 5/03; A63C 7/1066
See application file for complete search history.

(56) References Cited

U.S. PATENT DOCUMENTS

| | | | | |
|---|---|---|---|---|
| 2,828,135 | A * | 3/1958 | Koci | 280/605 |
| 3,437,345 | A * | 4/1969 | Berta | 280/607 |
| 3,781,026 | A * | 12/1973 | Bovee | 280/605 |
| 5,085,455 | A * | 2/1992 | Bogner et al. | 280/618 |
| 6,971,483 | B2 * | 12/2005 | Houston | 188/8 |
| D649,212 | S * | 11/2011 | Geiger | D21/760 |
| 8,083,251 | B2 * | 12/2011 | Wasserman | 280/604 |
| 8,157,285 | B2 * | 4/2012 | Wasserman | 280/604 |
| 8,286,989 | B2 * | 10/2012 | Wasserman | 280/604 |
| 8,517,410 | B2 * | 8/2013 | Pedersen et al. | 280/609 |
| 2004/0036257 | A1 * | 2/2004 | Lille et al. | 280/604 |
| 2005/0062240 | A1 * | 3/2005 | Holt | 280/28.11 |
| 2009/0026731 | A1 * | 1/2009 | Stewart, III | 280/611 |
| 2009/0200772 | A1 * | 8/2009 | Rassman et al. | 280/605 |

FOREIGN PATENT DOCUMENTS

| | | | | |
|---|---|---|---|---|
| FR | 2649329 | A1 * | 1/1991 | A63C 5/03 |

* cited by examiner

*Primary Examiner* — Paul N Dickson
*Assistant Examiner* — Steve Clemmons
(74) *Attorney, Agent, or Firm* — Bay State IP, LLC

(57) ABSTRACT

A snowboard binding and braking system and accompanying apparatuses which afford the user enhanced balance, control and snowboard braking ability. The system includes a foot securing member, in conjunction with a braking system. The instant apparatus also includes a brake control actuator and a braking arm to prevent the board from sliding away.

16 Claims, 9 Drawing Sheets

SNOWBOARD BINDING AND BRAKING SYSTEM

CROSS REFERENCE TO RELATED APPLICATION

This applications claims priority to and takes the benefit of U.S. Provisional Patent Application Ser. No. 61/748,607 filed on Jan. 3, 2013, the contents of which are herein incorporated by reference.

BACKGROUND OF THE INVENTION

1. Field of the Invention

The present invention generally relates to devices that allow a user to glide over snow, and more particularly to recreational use snowboards. Specifically, the present invention relates to snowboards with a foot securing system and a mechanical braking system to prevent runaway boards.

2. Description of the Related Art

When it snows, and especially if school is closed, many people in the neighborhood flock to a local hill or park to take their children sledding. A variety of devices can be used to glide down a hill or embankment, providing a thrilling experience to the rider. The devices vary from wooden and plastic sliders, sleds with rails, blow up snow tubes, and skateboard-type boards called snowskates. These devices generally do not have any kind of binding to secure the rider.

The sled, slider or tube rider typically lies flat or sits on the device though the more adventurous may try to stand. The snowskate rider stands on the device. Riders may also use alpine skis and snowboards, which also are ridden standing up. Alpine skis and snowboards differ from the other devices in that they have devices to hold the rider to the skis or board.

Alpine skis and snowboards require the rider to wear large and heavy boots, which are secured to the ski or board with a complicated binding mechanism. There are some slip-on type bindings found on some snowboards, which are like slider slippers, where a user may slide their foot under a strap, but are also clumsy and do not allow the user to release easily when stopping or in a fall, nor do they arrest the board. The binding of the foot to the skis or board enables the user to turn and brake by tilting the device sideways, so that the lateral edge of the device digs into the snow, creating friction, resulting in a turn or stop. Without this binding, a skier or snowboarder would be less able to effectively turn and stop, unable to remain on the board during use and while going over jumps and other obstacles, and unable to have the device stop on its own if the rider were to fall off, absent a separate arresting device. However, the binding and braking mechanisms of alpine skis and snowboards are complicated and impractical for light recreational use, and thus these skis and snowboards are generally not used on smaller hills outside of alpine resorts.

As specialized boots and complicated binding mechanisms are also impractical for recreational sleds, sliders, tubes and snowskates, often the only means of initiating turns and stops on such a device is for the rider to lean on one or the other lateral edge. Without such specialized boots and binding mechanisms, another way of arresting the movement of the board must be found, or the board will continue to move without the rider, potentially becoming runaway or causing harm to property and/or persons. Thus, the typical sled, slider, tube, or snowskate lacks any real means of easily securing a rider to the device, in addition to a braking system that prevents a runaway device should the user disengage or fall from it.

SUMMARY OF THE INVENTION

The instant apparatus and system, as illustrated herein, is clearly not anticipated, rendered obvious, or even present in any of the prior art mechanisms, either alone or in any combination thereof. A snowboard binding system that secures the rider to the board, and additionally brakes the board from travelling on its own. Thus the several embodiments of the instant apparatus are illustrated herein.

It is therefore an object of the present system, in one example, to quickly secure the foot of a rider to a snowboard.

It is another object of the invention, in one example, to provide a braking mechanism for a snowboard that prevents the snowboard from gliding away when not in use.

It is a further object of the invention, in one example, to simultaneously secure the foot of a rider to a snowboard while releasing the braking mechanism.

It is another object of the invention, to provide a binding system that allows for an individual user of the board to remain on the board during use and while going over jumps and other obstacles.

It is another object of the invention, to provide a binding system that works in conjunction with the forces supplied by an individual user's front foot and a brake control actuator.

It is another object of the invention, to provide a binding system that requires a user only to secure one foot on the board, and allows the rear foot to remain secure until the user of the system releases the brake control actuator or in a fall, allows the user to freely release.

It is another object of the invention in an alternative embodiment to provide a binding system that enables a user to easily switch between regular and goofy foot riding by means of sliding the binding back and forth on an interchangeable riding system.

It is another object of the invention in an alternative embodiment to provide a binding system with a pair of braking mechanisms for a snowboard that prevents the snowboard from gliding away when not in use.

It is another object of the invention to provide a binding and braking system that includes a side cut on either side of the board for greater control by a user and to improve the overall riding experience.

The invention results, in one example, from the realization that the dual problems of binding a foot to and providing a brake once the user disengages from the board for a light use recreational snowboard are solved by a binding/braking mechanism that simultaneously secures the rider's feet while releasing a brake.

There has thus been outlined, rather broadly, the more important features of the binding and braking system in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention. To the accomplishment of the foregoing and related ends, certain illustrative aspects are described herein and these aspects are indicative of the various ways in which the principles disclosed herein can be practiced and all aspects and equivalents thereof are intended to be within the scope of the claimed subject matter.

DETAILED DESCRIPTION OF THE PREFERRED EMBODIMENTS

Figure 1:
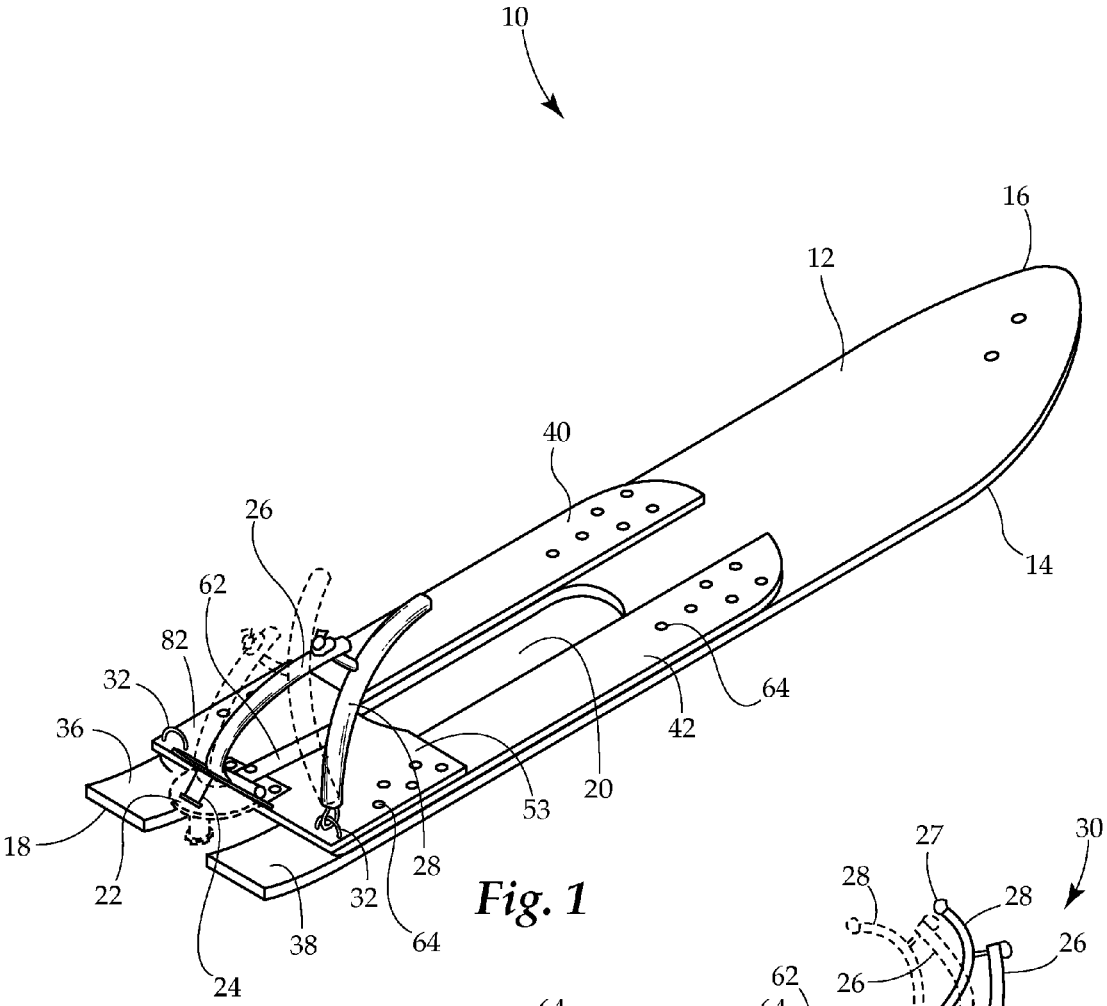
FIG. 1 illustrates a top side perspective view of one embodiment of the instant system, wherein a snowboard binding and braking system includes a board having a pair of support ribs and a brake mechanism base supporting a braking system.
Figure 2:
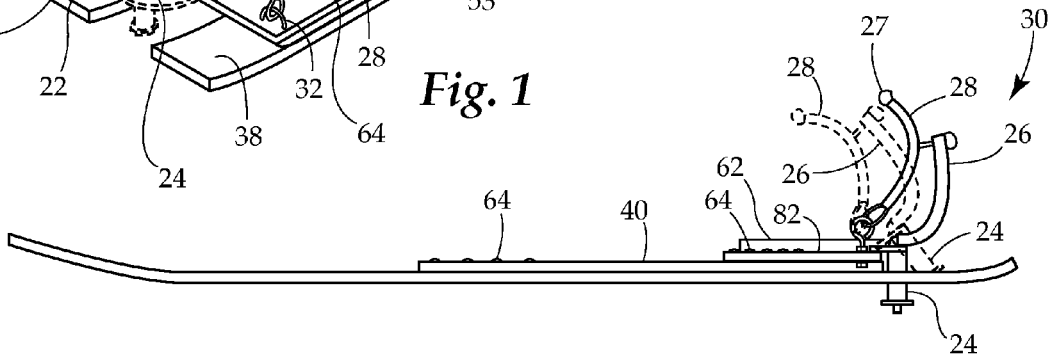
FIG. 2 illustrates a side perspective view of one embodiment of the instant system further illustrating the binding system and the braking system.
Figure 3:
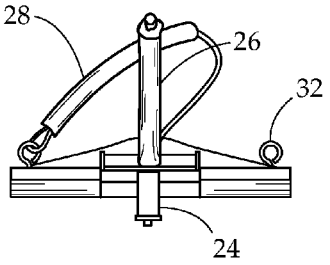
FIG. 3 illustrates a back side perspective view of the binding system and braking system, including a user-controlled braking arm connected to a spring-loaded hinge.
Figure 4:
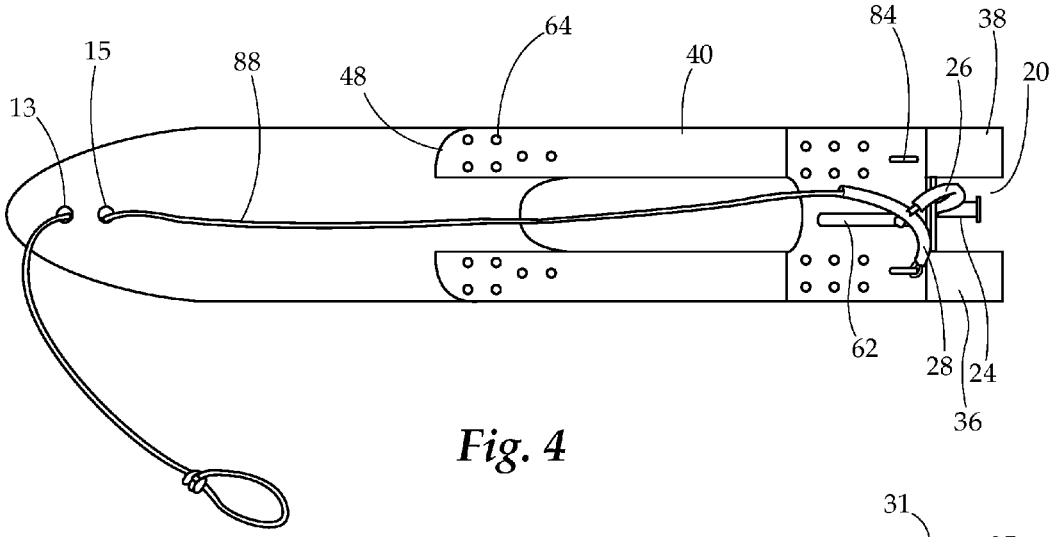
FIG. 4 illustrates a top perspective view of one embodiment of the instant system, including a middle cavity, along with a brake control actuator connected to the binding system.
Figure 5:
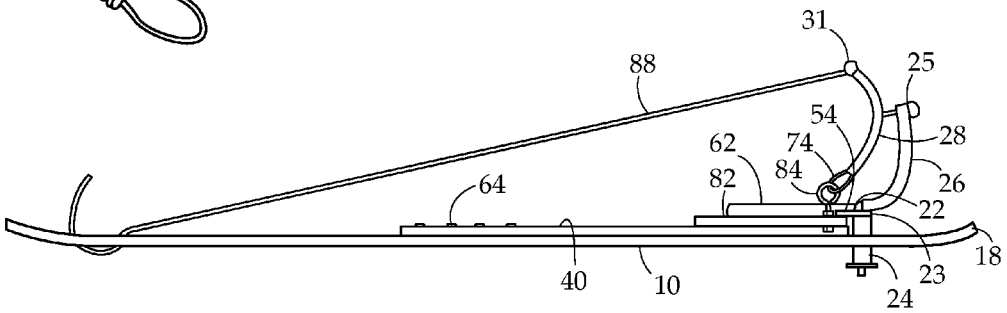
FIG. 5 illustrates a side view of one embodiment of the instant system including the brake control actuator connected to a foot securing member to secure a user's foot in place on the board.
Figure 6:
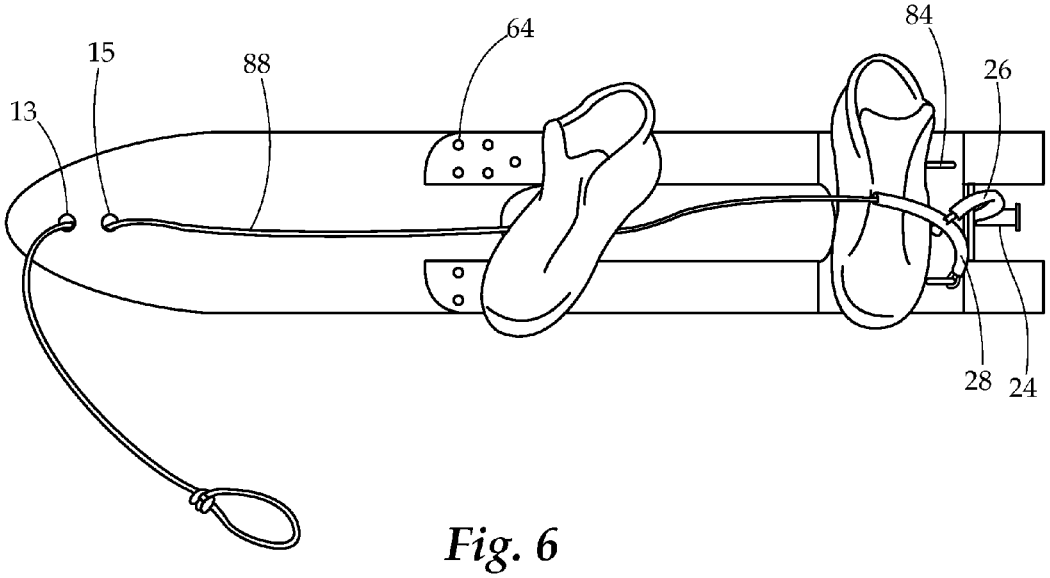
FIG. 6 illustrates a top view of one embodiment of the instant system in use, wherein a user's rear foot is positioned on the board and secured by the foot securing member, and a user's front foot near the middle of the board and on top of the brake control actuator.
Figure 7:
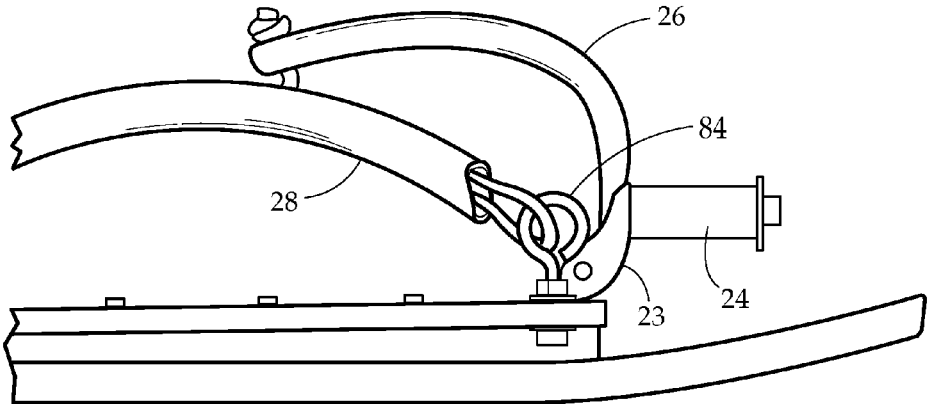
FIG. 7 illustrates an exploded view of the binding system and the braking system of the instant invention, wherein the braking arm is in a non-engaged position on a distal end of the spring-loaded hinge mechanism.

FIGS. 1-7 illustrate one embodiment of a snowboard binding and braking system, wherein a board 10 includes a top surface 12 and a bottom surface 14. In one embodiment, the bottom surface 14 of the board 10 may be coated with a material that reduces friction, enabling the board 10 to glide freely along a snowy surface. Preferably, the board 10 comprises a nose section 16 and a tail section 18, wherein each section 16, 18 may be curved slightly upwards to prevent the board 10 from submarining under the snow and also to better traverse any loose objects such as stones or branches. Additionally, the tail section 18 includes a middle cavity 20 that spans from the tail section 18 to approximately slightly less than the middle of the board 10, thereby creating a left section 36 and a right section 38. Furthermore, the board 10 includes a pair of wooden support ribs 40, 42 that preferably span from near the middle of the board 10 towards near the end of the tail section 18. A brake mechanism base 82 is located on top of the pair of wooden support ribs 40, 42 near the tail section 18 of the board 10, and preferably spans across the board from the left section 36 to the right section 38. In one embodiment, the brake mechanism base 82 may leave an open space underneath and act as a foot rest for a user's rear foot, which foot would be secured by a binding mechanism. The wooden support ribs 40, 42 provide a raised surface for the attachment of a braking system 30. Furthermore, a plurality of gripping mechanisms 64 may be included on the front ends of the wooden support ribs 40, 42 and the brake mechanism base 82 to prevent a user's feet from slipping off the board 10 depending on conditions.

In one embodiment, the braking system 30 is attached to the brake mechanism base 82; in particular the braking system 30 includes a spring-loaded hinge 22, wherein the spring-loaded hinge 22 is mounted in a way that during non-use, a distal end 23 of the hinge 22 is parallel with the top surface 12 of the board 10. The braking system 30 further includes a braking arm 24 attached to the bottom of the distal end 23 of the spring-loaded hinge 22. During use of the instant invention, when the hinge 22 is at rest and parallel with the top surface 12, the braking arm member 24 extends downwardly through the middle cavity 20 and in a perpendicular direction with respect to the orientation of the board 10, thereby coming into contact with the snowy surface below and arresting movement of the board 10. In one embodiment, the braking arm member 24 may be released by having a user engage a brake control member 26, which is attached to a top side of the spring-loaded hinge 22, thus causing the braking arm 24 to angle up through the middle cavity 20 and into a parallel direction with respect to the orientation of the board 10 thereby allowing the board 10 to glide freely.

The braking system 30 also features a means for quickly binding a user's foot to the board 10 while simultaneously releasing the braking arm 24, without any need for a specialized boot or shoe. The board 10 also includes a foot securing member 28, wherein the foot securing member 28 preferably clips into either the left section 36 or right section 38 of the tail section 18 of board 10, (depending on the rider's stance) through a pair of eye bolts 32 located on each end of the tail section 18. In this embodiment, one end of the foot securing member 28 is affixed to the brake control member 26, so that when the brake control member 26 is engaged, the foot securing member 28 moves with it. The braking system 30 may also be constructed in a manner that allows the rider to modulate the brake control member 26, allowing the user to easily disengage from the board 10 and once disengaged, the board 10 will cease movement by the braking arm 24 making contact with the ground or surface. In alternate embodiments, the position of the braking system 30 could be moved longitudinally along the board 10 to more comfortably accommodate a rider's stance. In this particular configuration, the spring-loaded hinge 22 at rest causes braking arm 24 to extend through the middle cavity 20 and past the bottom surface 14. The braking arm 24 comes into contact with the substrate below, preventing the board member 10 from sliding away. If the spring-loaded hinge 22 is pulled open by pulling brake control member 26, the braking arm 24 is no longer in contact with the substrate below, and the board 10 can freely move.

Additionally, a rider's foot may be lightly secured with a foot support member 62, in this embodiment, a five inch section of flexible vinyl tubing. Preferably, the foot support member 62 is fastened to a proximal end 21 of the spring-loaded hinge 22 at one end, with the other end of the foot support member 62 fastened to a proximal end 53 of the brake mechanism base 82 such that the foot support member runs longitudinally across the brake mechanism base 82. The foot support member should fit within the arch of the rider's shoe or boot, preventing the rider's foot from moving towards either edge of the board member 10.

The instant invention further includes a brake control actuator 88, wherein the brake control actuator 88 is secured to a distal end 31 of the foot securing member 28, in this embodiment a five foot strand of nylon rope. The brake control actuator 88 extends from the distal end 31 of the foot securing member 28 through a first aperture 15 in the nose section 16 of the board member 10, and returns back through a second aperture 13. The rider of the board 10 may then grip the brake control actuator 88 threaded through the second aperture 13 and pull it upwards, tightening the foot securing member 28 against the top of the rider's shoe or boot.

In one embodiment of the instant invention, a user may be secured to the board 10 by engaging the brake control actuator 88; in another embodiment, the user's foot may be snapped or secured into place; however the user still would need the brake control actuator 88 from the user's arm to function. Additionally, the brake control actuator 88 at the nose section 16 of board 10 is preferably counteracted by the pushing down of the front foot of the user, and the two forces are even with the force of the back foot. In yet another embodiment, the brake control actuator 88 may act alone to hold a user's foot in place, or the user's foot may be secured separately while the brake control actuator 88 acts as the trigger, or the brake control actuator 88 could act in conjunction with the foot securing member 28.

Therefore, in the preferred embodiment of the instant invention, a user pulling the brake control actuator 88 simultaneously tightens the foot securing member 28 around the user's boot, and in turn lifts the braking arm 24 up so that the board 10 may freely glide along a surface. Conversely, by releasing the brake control actuator 88, tension is relieved on the spring-loaded hinge 22, which simultaneously loosens the foot securing member 28 and places the braking arm 24 in contact with the substrate below the board 10 to apply an arresting action once the user removes themselves or falls away from the board and binding system.

In the preferred operation of the instant invention, a user of the board 10 first slides his foot underneath the foot securing member 28 and brake control member 26. Next, the user engages the brake control actuator 88 and thereby pulls foot securing member 28 down over the top of the user's foot and snaps it in place on the board, simultaneously releasing the braking arm 24. In alternate embodiments, the brake control member 26 may be secured to the board in a variety of ways, including clipping or tying it to the board surface. The safely secured rider of the board 10 may now glide down a hill or other embankment. When the rider reaches the bottom of the hill, he or she may release the brake control member 26 through relieving tension on the brake control actuator 88, and then remove his or her foot; through this action the braking arm 24 is also released, preventing the board from gliding away.

Figure 8A:
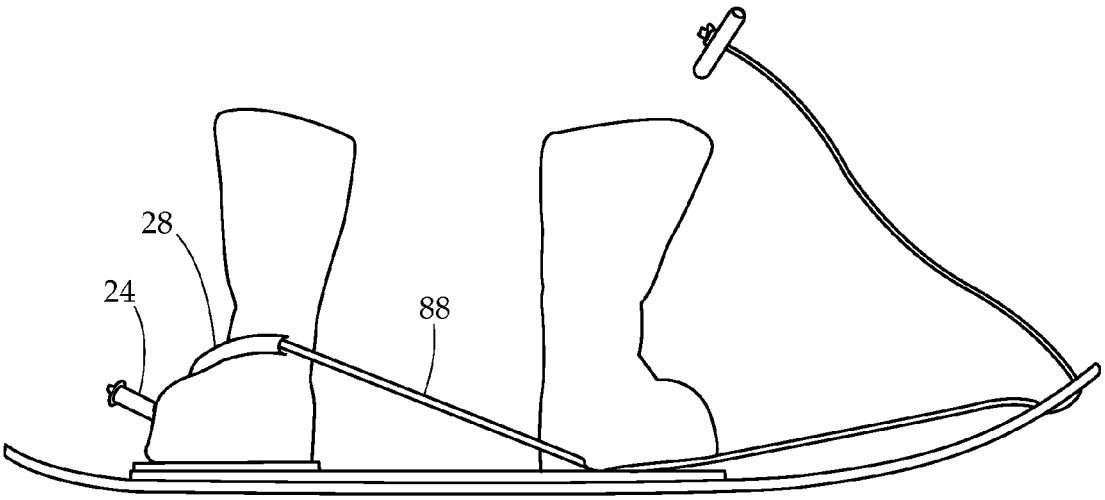
FIGS. 8A-8B illustrate a side and top view respectively of one embodiment of the instant system highlighting a three-point system of forces that enable a user of the system to maintain contact with the board during use both while riding on a surface and/or while in the air.
Figure 8B:
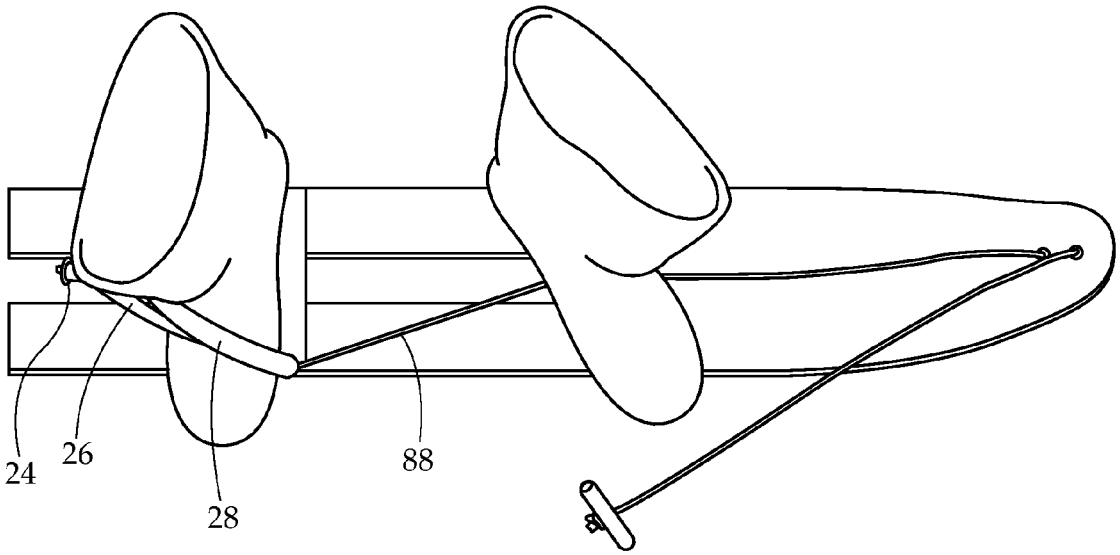
Figure 9A:
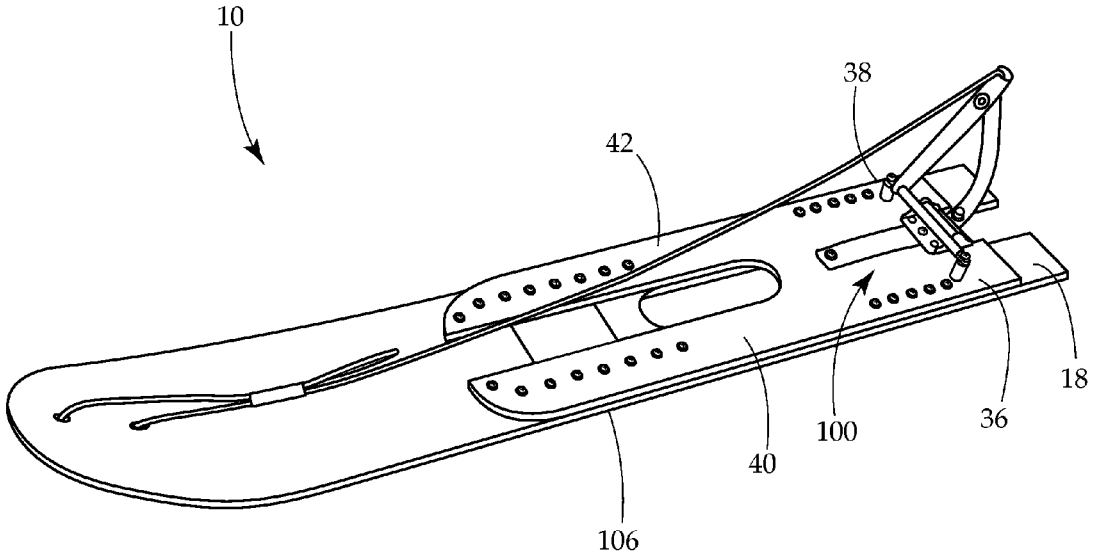
FIGS. 9A-9B illustrate a pair of top views of an alternate embodiment of the instant system, wherein the binding system includes an interchangeable riding system to allow a user to easily switch riding styles.
Figure 9B:
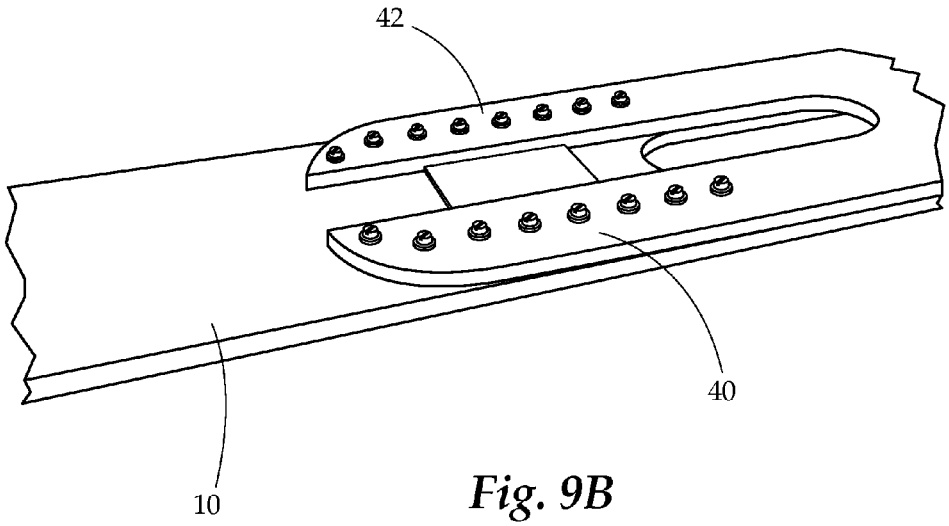
Figure 10A:
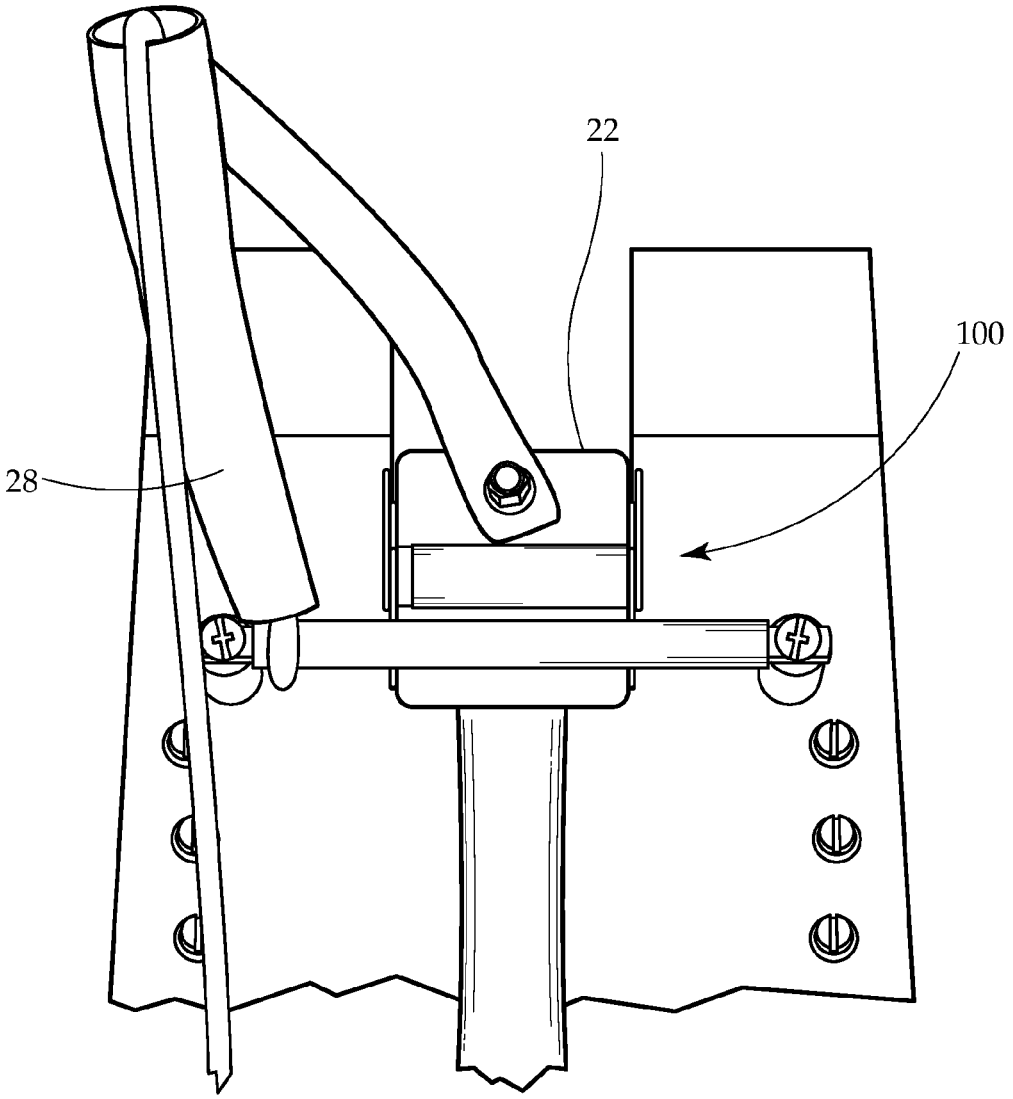
FIGS. 10A-10C illustrate exploded views of an alternate embodiment of the binding system having the interchangeable riding system in combination with the brake control member and the foot securing member.
Figure 10B:
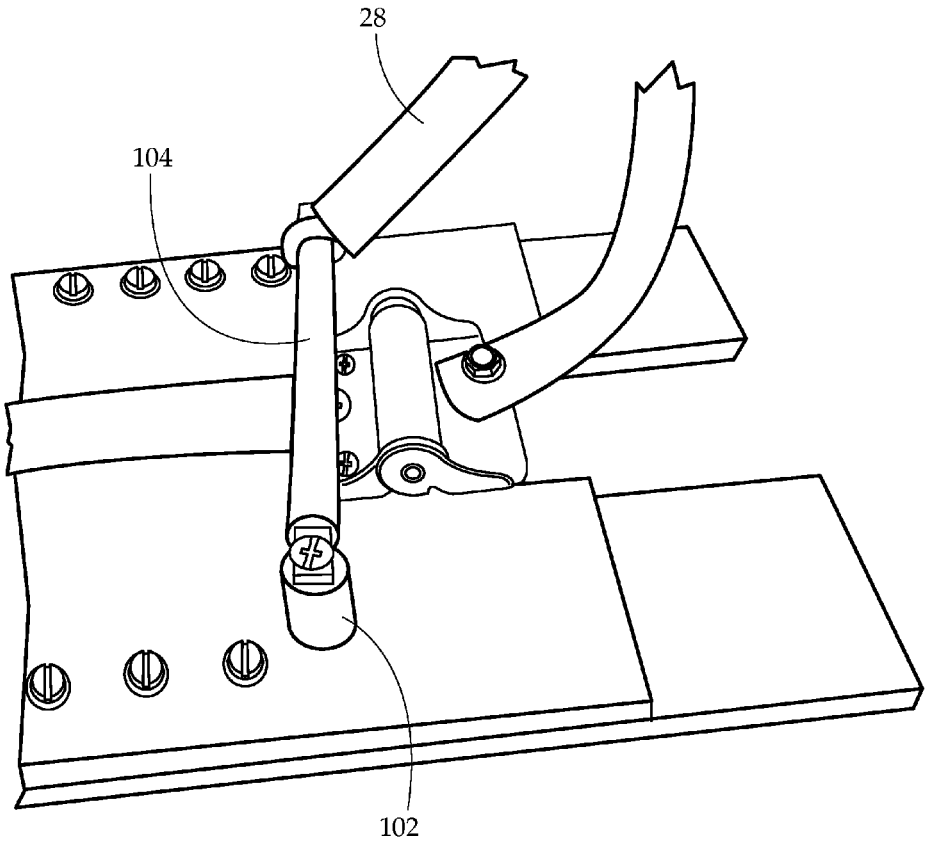
Figure 10C:
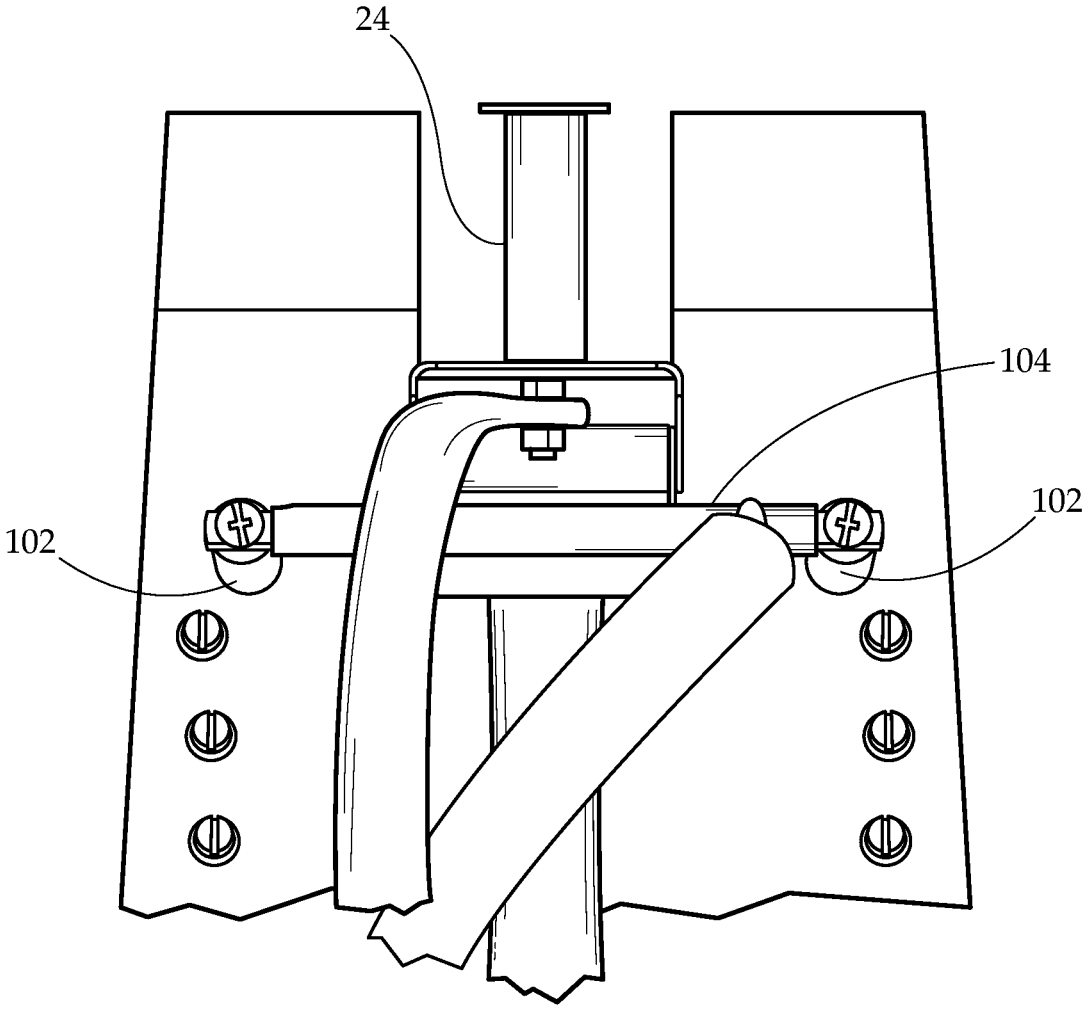

FIGS. 8A-8B illustrate one embodiment of the three-point system of the instant invention to allow for the user to maintain contact with the board 10 during use on the ground and while the board 10 is in the air after going over an obstacle allowing the board 10 to leave the ground. In particular, when a user engages the braking system by placing the foot securing member 28 and brake control member 26 over the user's rear foot, and the user grabs the brake control actuator 88, the user is now easily able to maintain contact with the board 10 during use. Therefore, with the brake control actuator 88 engaged, the foot securing member 28 and brake control member 26 act to hold the user's rear foot onto the board 10; additional leverage may be created by the user placing their front foot on one end of the brake control actuator to more strongly secure the user's rear foot with the foot securing member 28 and the brake control member 26. Therefore, in this embodiment, the user of the board 10 remains fixed to the board 10 while either on a surface or while in the air after going over a jump, as the board 10 remains balanced and flat allowing for a smooth and controlled landing.

FIGS. 9A-10C illustrate an alternate embodiment of the instant invention, wherein the board 10 includes the pair of wooden support ribs 40 and 42 near the middle of the board 10 that extend towards the tail section 18 across the board 10 from the left section 36 to the right section 38 at the tail section 18. In this embodiment, the brake mechanism base 82 (see FIG. 1) is not required as the spring-loaded hinge 22 is directly attached to the wooden support members 40 and 42 at the tail section 18 of the board 10. Furthermore, an interchangeable riding system 100 is shown in place of the pair of eye bolts 32 (see FIG. 1), wherein the interchangeable riding system 100 comprises a pair of cylindrical members 102 extending upwardly from the tail section 18 of the board 10 and connected by a support member 104. Additionally, in this embodiment, the foot securing member 28 is slidably attached to the support member 104 thereby enabling a user of the board 10 to switch between riding styles without needing to unclip the foot securing member 28 from the eye bolts 32 as shown in previous embodiments. Moreover, in this embodiment the board 10 may include a slight side cut 106 such that the width near the middle section of the board 10 is less than the width of the board near the tip 16 and tail 18 sections to improve the riding experience.

Figure 11A:
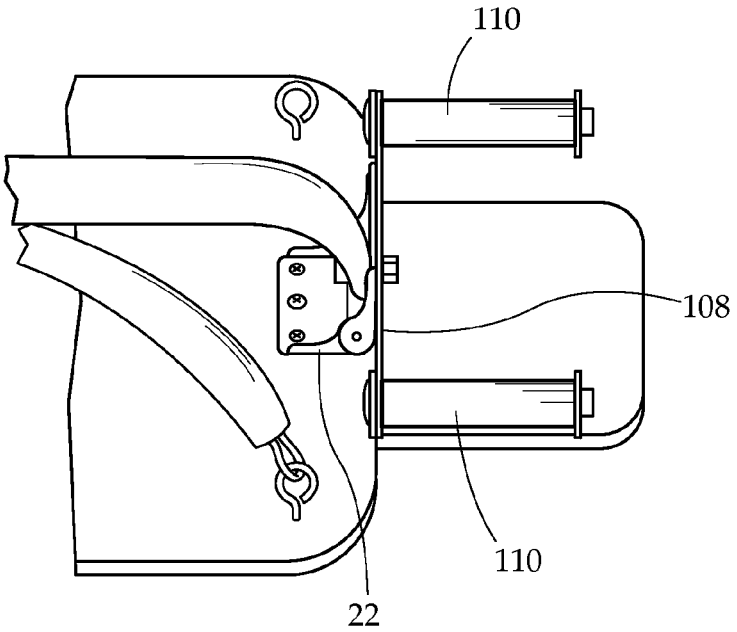
FIGS. 11A-11B illustrate exploded views of an alternate embodiment of the braking system of the instant invention, wherein the braking system includes a pair of braking arms attached to the spring-loaded hinge via a braking arm securing member.
Figure 11B:
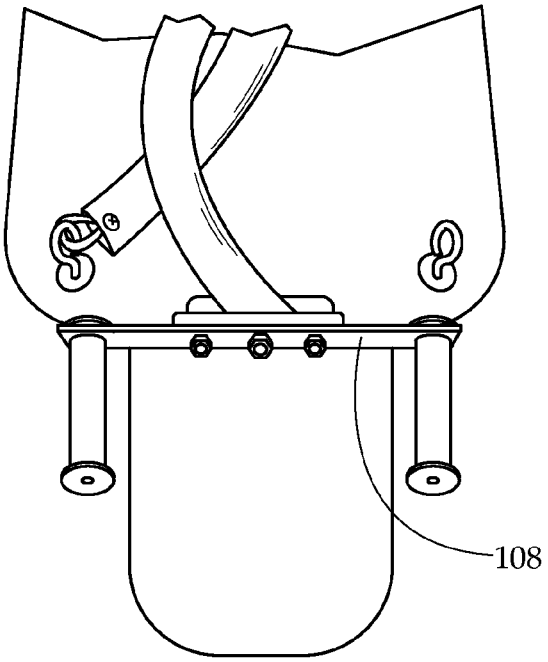

FIGS. 11A-11B illustrate yet another alternate embodiment of the instant invention, wherein a braking arm securing member 108 is attached to the distal end 23 (see FIG. 5) of the spring-loaded hinge 22 and extends outwardly along the tail section 18 of the board 10. In this embodiment, a pair of braking arms 110 located on either end of the braking arm securing member 108 extend downwardly from the braking arm securing member 108 to arrest the movement of the board 10 when engaged.

In conclusion, herein is presented a snowboard binding and braking system for securing a user of the system to the board in conjunction with the forces of the user's front foot and the brake control actuator. The invention is illustrated by example in the drawing figures, and throughout the written description. It should be understood that numerous variations are possible, while adhering to the inventive concept. Such variations are contemplated as being a part of the present invention.

What is claimed is:

1. A binding and braking system comprising:

a board, wherein the board further comprises:

a nose section and a tail section, wherein the tail section comprises a middle cavity that spans from the tail section to near middle of the board to create a left section and a right section;

a pair of support ribs, wherein the pair of support ribs span from near middle of the board toward near the tail section; and a brake mechanism base located on top of the pair of support ribs which spans across the board from the left section to the right section;

a braking system, wherein the braking system is attached to the brake mechanism base and further comprises:

a spring-loaded hinge;

a braking arm, attached to a bottom of a distal end of the spring-loaded hinge;

a brake control member attached to a top of the spring-loaded hinge;

a foot-securing member, wherein the foot-securing member clips into the left and right section of the board through a pair of eye bolts located on each end of the tail section and is affixed to the brake control member;

a foot support member fastened to a proximal end of the spring-loaded hinge at one end and fastened to a proximal end of the brake mechanism base at the other end; and a brake control actuator, wherein the brake control actuator is secured to a distal end of the foot-securing member and extends from the distal end of the foot-securing member through a first aperture in the nose section and returns back through a second aperture.

2. The binding and braking system of claim 1, further comprising:

a plurality of gripping mechanism on a front end of the support ribs to prevent a user's feet from slipping off the board.

3. The binding and braking system of claim 1, wherein the nose section and the tail section of the board is curved slightly upwards.

4. The binding and braking system of claim 1, wherein the brake mechanism base creates an open space underneath and acts as a foot rest for a user's rear foot.

5. The binding and braking system of claim 1, wherein the distal end of the spring-loaded hinge is raised when the brake control actuator is engaged parallel with a top surface of the board during non-use.

6. The binding and braking system of claim 1, wherein when the brake control actuator is released, during use, the braking arm extends downwardly through the middle cavity and in a perpendicular direction with respect to orientation of the board to come into contact with the surface to arrest movement of the board.

7. The binding and braking system of claim 1, wherein a user of the board pulls the brake control actuator upward to tighten the foot securing member against the top of the user's boot.

8. A binding and braking system for a snowboard, comprising:

a board, wherein the board further comprises:

a nose section and a tail section;

a pair of support ribs;

a braking system, wherein the braking system is attached to the pair of support ribs and further comprises:

a spring-loaded hinge;

a braking arm, attached to a bottom of a distal end of the spring-loaded hinge;

a brake control member attached to a top of the spring-loaded hinge;

an interchangeable riding system, wherein the interchangeable riding system further comprises:

a pair of cylindrical members extending upwardly from the tail section of the board and connected by a support member;

a foot-securing member, wherein the foot-securing member is slidably attached to the support member; and a brake control actuator;

wherein the brake control actuator is secured to a distal end of the foot-securing member and extends from the distal end of the foot-securing member through a first aperture in the nose section and returns back through a second aperture.

9. The binding and braking system for a snowboard of claim 8, wherein the board includes a side cut such that the width near the middle section of the board is less than the width of the board near the nose and tail sections.

10. The binding and braking system of claim 8, wherein the distal end of the spring-loaded hinge is raised when the brake control actuator is engaged parallel with a top surface of the board during non-use.

11. The binding and braking system of claim 8, wherein when the brake control actuator is released, during use, the braking arm extends downwardly through the middle cavity and in a perpendicular direction with respect to orientation of the board to come into contact with the surface to arrest movement of the board.

12. The binding and braking system of claim 8, wherein a user of the board pulls the brake control actuator upward to tighten the foot securing member against the top of the user's boot.

13. A binding and braking system comprising:

a board, wherein the board further comprises:

a nose section and a tail section, wherein the tail section comprises a middle cavity that spans from the tail section to near middle of the board to create a left section and a right section;

a pair of support ribs, wherein the pair of support ribs span from near middle of the board toward near the tail section; and a brake mechanism base located on top of the pair of support ribs which spans across the board from the left section to the right section;

a braking system, wherein the braking system is attached to the brake mechanism base and further comprises:

a spring-loaded hinge;

a braking arm securing member attached to a distal end of the spring-loaded hinge and extending outwardly along the tail section of the board;

a pair of braking arms located on either end of the braking arm securing member extend downwardly;

a brake control member attached to a top of the spring-loaded hinge;

a foot-securing member, wherein the foot-securing member clips into the left and right section of the board through a pair of eye bolts located on each end of the tail section and is affixed to the brake control member;

a foot support member fastened to a proximal end of the spring-loaded hinge at one end and fastened to a proximal end of the brake mechanism base at the other end; and a brake control actuator, wherein the brake control actuator is secured to a distal end of the foot-securing member and extends from the distal end of the foot-securing member through a first aperture in the nose section and returns back through a second aperture.

14. The binding and braking system of claim 13, wherein the distal end of the spring-loaded hinge is raised when the brake control actuator is engaged parallel with a top surface of the board during non-use.

15. The binding and braking system of claim 13, wherein when the brake control actuator is released, during use, the braking arm extends downwardly through the middle cavity and in a perpendicular direction with respect to orientation of the board to come into contact with the surface to arrest movement of the board.

16. The binding and braking system of claim 13, wherein a user of the board pulls the brake control actuator upward to tighten the foot securing member against the top of the user's boot.

* * * * *